US005283167A

United States Patent [19]

Chari et al.

[11] Patent Number: 5,283,167

[45] Date of Patent: Feb. 1, 1994

[54] DIRECT-POSITIVE PHOTOGRAPHIC MATERIALS CONTAINING A NUCLEATOR IN SOLID PARTICLE DISPERSION FORM

[75] Inventors: Krishnan Chari; Douglas E. Corbin; Glenn M. Brown, all of Rochester; Harry A. Hoyen, Webster, all of N.Y.

[73] Assignee: Eastman Kodak Company, Rochester, N.Y.

[21] Appl. No.: 828,431

[22] Filed: Jan. 30, 1992

[51] Int. Cl.[5] ..... G03C 1/295

[52] U.S. Cl. ..... 430/598; 430/940; 430/487

[58] Field of Search ..... 430/487, 546, 598, 940

[56] References Cited

U.S. PATENT DOCUMENTS

| | | | |
|---|---|---|---|
| 4,115,122 | 9/1978 | Adachi et al. | 430/598 |
| 4,140,530 | 2/1979 | Trunley et al. | 430/546 |
| 4,474,872 | 10/1984 | Onishi et al. | 430/546 |
| 4,801,520 | 1/1989 | Inoue et al. | 430/378 |
| 4,855,220 | 8/1989 | Szajewski | 430/505 |
| 4,857,446 | 8/1989 | Diehl et al. | 430/510 |
| 4,880,729 | 7/1989 | Heki et al. | 430/598 |
| 4,900,653 | 2/1990 | Factor et al. | 430/522 |

FOREIGN PATENT DOCUMENTS

| | | |
|---|---|---|
| 0182293 | 11/1985 | European Pat. Off. . |
| 0249239 | 3/1987 | European Pat. Off. . |
| 0255009 | 7/1987 | European Pat. Off. . |
| 0278986 | 8/1987 | European Pat. Off. . |
| 0283041 | 3/1988 | European Pat. Off. . |
| 0276842 | 6/1988 | European Pat. Off. . |
| 0283040 | 8/1988 | European Pat. Off. . |
| 0311110 | 10/1988 | European Pat. Off. . |
| 0315890 | 11/1988 | European Pat. Off. . |
| 0331185 | 11/1989 | European Pat. Off. . |

OTHER PUBLICATIONS

English language translation of German OFF DE 3,721,570 dated Jan. 7, 1988.

*Primary Examiner*—Janet C. Baxter
*Attorney, Agent, or Firm*—Alfred P. Lorenzo

[57] ABSTRACT

A direct-positive image-forming photographic material comprises a supporting substrate bearing a light sensitive, nonprefogged silver halide photographic emulsion capable of forming an internal latent image and includes a water-insoluble nucleator. The nucleator is incorporated in the photographic material in the form of a solid particle dispersion to improve the storage stability of the photographic material. The development rate of the photographic material may be increased by use of a developer containing an activator for the nucleator.

12 Claims, No Drawings

DIRECT-POSITIVE PHOTOGRAPHIC MATERIALS CONTAINING A NUCLEATOR IN SOLID PARTICLE DISPERSION FORM

FIELD OF THE INVENTION

The present invention relates to direct-positive photographic materials comprising a light-sensitive, nonprefogged silver halide photographic emulsion and a water-insoluble nucleator. More particularly, the present invention relates to such materials having improved storage stability and to improved methods for developing such materials.

BACKGROUND OF THE INVENTION

Direct-positive photographic materials comprising a supporting substrate bearing a light-sensitive, nonprefogged silver halide photographic emulsion are well known in the art. The Hayashi et al European Patent Application No. 331,185 discloses a silver halide photographic element for forming direct-positive images. The photographic element is particularly adapted for black-and-white computer output microfilm (COM) use. The Heki et al U.S. Pat. No. 4,880,729 also discloses direct-positive image-forming photographic elements. The Heki et al elements are suitable for use in color photographic systems.

It is also well known to employ nucleating agents in combination with silver halide emulsions. For example, heterocyclic quaternary ammonium compounds have been used as nucleus-forming agents in internal latent image type direct-positive silver halide emulsions, and have been used for increasing sensitivity and/or gradation in negative-type surface latent image forming silver halide emulsions. European Patent Applications Nos. 276,842 and 249,239 specifically disclose the use of heterocyclic quaternary ammonium compounds as nucleating agents. Similar nucleating agents are also disclosed in European Patent Applications Nos. 255,009, 278,986, 283,040, 283,041, 311,110, 315,890 and 331,185.

Commonly, the nucleating agents are incorporated in the photographic emulsion by dissolving the nucleating agent in a suitable solvent and mixing the dissolved agent with gelatin and silver halide and any other required components. As an alternative to incorporation in the silver halide emulsion, the nucleating agent can be incorporated in any other suitable layer of the photographic material, such as an interlayer, subbing layer or overcoat layer. However, a significant disadvantage of incorporating nucleating agents in photographic materials by dissolving them in solvents is that the resulting photographic materials exhibit relatively poor incubation stability, i.e., they have a relatively poor shelf life or storage stability.

Accordingly, a need exists for direct-positive photographic materials which contain a nonprefogged silver halide emulsion and a nucleating agent and which exhibit improved shelf life and storage stability.

SUMMARY OF THE INVENTION

It is therefore an object of the present invention to provide an improved direct-positive image-forming photographic material comprising a nonprefogged silver halide photographic emulsion capable of forming an internal latent image. It is a further object of the invention to provide an improved direct-positive photographic material comprising a nonprefogged silver halide photographic emulsion in combination with a nucleator. It is a more specific object of the invention to provide a direct-positive photographic material which includes a nonprefogged silver halide emulsion and a nucleator, and which material exhibits improved storage stability and shelf life. It is a further object of the invention to provide an improved method for developing such a photographic material.

These and additional objects are provided by the materials and methods of the present invention. According to the present invention, a direct-positive photographic material is provided comprising a supporting substrate bearing a light-sensitive, nonprefogged silver halide photographic emulsion capable of forming an internal latent image. The direct-positive photographic material includes a solid particle dispersion of a water-insoluble nucleator. The present inventors have discovered that the use of a solid particle dispersion of the water-insoluble nucleator overcomes disadvantages of the prior art and provides direct-positive photographic materials having improved shelf life and storage stability. A solid particle dispersion of the nucleator in gelatin also has the advantage of enhanced storage stability as compared to a solution of the nucleator in a solvent, thereby facilitating the manufacturing process. Applicants have also discovered that the rate of development of such direct-positive photographic materials containing a silver halide emulsion and a solid particle dispersion of a water-insoluble nucleator may be increased by including an activator for the nucleator in the developing solution.

These and additional objects and advantages will be more fully apparent in view of the following detailed description.

DETAILED DESCRIPTION

The direct-positive image-forming photographic materials according to the present invention comprise a supporting substrate bearing a light-sensitive, nonprefogged silver halide photographic emulsion capable of forming an internal latent image, and include a solid particle dispersion of a water-insoluble nucleator. Direct-positive imaging-forming photographic elements are generally known in the art. European Patent Application No. 31,185 discloses such elements for use in black-and-white photographic systems, while the Heki et al U.S. Pat. No. 4,880,729 discloses such elements for use in color photographic systems. Both of these references are incorporated herein by reference. The photographic elements of the present invention may be adapted for use in a black-and-white system or a color system.

Supporting substrates for use in photographic materials are well known in the art and any such substrates are suitable for use in the materials and methods of the present invention. Reference is particularly made to *Research Disclosure*, Item 17643, December 1978, published by Kenneth Mason Publications, Limited, Dudley Annex, 12A North Street, Emsworth, Hampshire P010 7DQ England, which *Research Disclosure* is incorporated herein by reference, Section XVII and the references described therein as setting forth suitable substrates for use in the present materials and methods.

The nonprefogged silver halide emulsions employed in the materials and methods of this invention are capable of forming internal latent images and can be comprised of silver bromide, silver chloride, silver iodide, silver chlorobromide, silver chloroiodide, silver bromoiodide, silver chlorobromoidide or mixtures thereof. The emulsions can include silver halide grains of any conventional shape or size. Specifically, the emulsions can include coarse, medium or fine silver halide grains. Useful tabular grain emulsions are described in *Research Disclosure*, Item 22534, and in U.S. Pat. No. 4,748,106, both of which are incorporated herein by reference. High aspect ratio tabular grain emulsions are specifically contemplated, such as those disclosed by Wilgus et al U.S. Pat. 4,434,226, Daubendiek et al U.S. Pat. No. 4,424,310, Wey U.S. Pat. No. 4,399,215, Solberg et al U.S. Pat. No. 4,433,048, Mignot U.S. Pat. No. 4,386,145, Evans et al U.S. Pat. No. 4,504,570, Maskasky U.S. Pat. No. 4,400,463, Wey et al U.S. Pat. No. 4,414,306, Maskasky U.S. Pat. Nos. 4,435,501 and 4,4414,966 and Daubendiek et al U.S. Pat. Nos. 4,672,027 and 4,693,964, all of which are incorporated herein by reference. Also specifically contemplated are those silver bromoiodide grains with a higher molar proportion of iodide in the core of the grain than in the periphery of the grain, such as those described in British Patent No. 1,027,146; Japanese Patent No. 54/48,521; U.S. Pat. Nos. 4,379,837; 4,444,877; 4,665,012; 4,686,178; 4,565,778; 4,728,602; 4,668,614 and 4,636,461; and in European Patent Application No. 264,954, all of which are incorporated herein by reference. The silver halide emulsions can be either monodisperse or polydisperse as precipitated. The grain size distribution of the emulsions can be controlled by silver halide grain separation techniques or by blending silver halide emulsions of differing grain sizes.

Sensitizing compounds, such as compounds of copper, thallium, lead, bismuth, cadmium and Group VIII noble metals, can be present during precipitation of the silver halide emulsion. The emulsions are internal latent image-forming emulsions, i.e., emulsions that form latent images predominantly in the interior of the silver halide grains.

The silver halide emulsions can be chemically sensitized, and noble metal (e.g., gold), middle chalcogen (e.g., sulfur, selenium, or tellurium) and reduction sensitizers, employed individually or in combination, are specifically contemplated. Typical chemical sensitizers are listed in *Research Disclosure*, Item 17643, cited above, Section III.

The silver halide emulsions can be spectrally sensitized with dyes from a variety of classes, including the polymethine dye class, which includes the cyanines, merocyanines, complex cyanines and merocyanines (i.e., tri-, tetra-, and polynuclear cyanines and merocyanines), oxonols, hemioxonols, styryls, merostyryls, and streptocyoanines. Illustrative spectral sensitizing dyes are disclosed in *Research Disclosure*, Item 17643, cited above, Section IV.

Suitable vehicles for the emulsion layers and other layers of elements of this invention are described in *Research Disclosure* Item 17643, Section IX and the publications cited therein.

As noted above, the photographic materials of the present invention are of the direct-positive or auto positive type comprising a nonprefogged photographic silver halide emulsion.

In accordance with an important feature of the invention, the photographic material includes a nucleator in the form of a solid particle dispersion. The inventors have discovered that this method of incorporation of the nucleator provides the photographic materials formed therewith with improved shelf life and storage stability. The nucleator included in the present materials and methods is water-insoluble and such compounds are well known in the art. In a preferred embodiment, the water-insoluble nucleator is of the Formula I

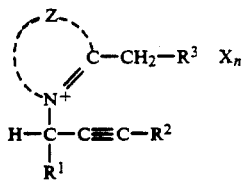

(I)

wherein Z includes an atomic group which forms an azolium or azinium ring with the quaternary ammonium nucleus, $R^1$ is hydrogen or methyl, $R^2$ is hydrogen or an alkyl group having 1 to 8 carbon atoms, $R^3$ is hydrogen or a substituent having a Hammett sigma value electron withdrawing characteristic of greater than −0.2, and, when taken together with Z, represents the atoms necessary to complete a ring structure, X is a charge balancing counter ion and n is zero or 1, provided that one of Z and $R^3$ includes a group for promoting adsorption by silver halide. In a further preferred embodiment wherein the nucleator is a compound of Formula (I), Z forms an indolium group with the quaternary ammonium nucleus or a quinolinium group with the quaternary ammonium nucleus.

As noted above, $R^3$ is hydrogen or a substituent having a Hammett sigma value electron withdrawing characteristic of greater than −0.2. As is known in the art, the sigma value represents the difference in $pK_a$ values of (1) the compound wherein $R^3$ is hydrogen and (2) the compound wherein $R^3$ is other than hydrogen, in an aqueous solution at 25° C. For a further discussion of the Hammett sigma value, see Gutsche et al, *Fundamentals of Organic Chemistry*, Prentice Hall, Inc. (1975), pages 568–572.

As also set forth above, one of Z and $R^3$ includes an adsorption-promoting group, such as a thioamido group, for promoting adsorption by silver halide. Useful thioamido adsorption-promoting groups are selected from those as described, for example, in U.S. Pat. Nos. 4,303,925, 4,031,127, 4,080,207, 4,245,037, 4,255,511, 4,266,013 and 4,276,364; *Research Disclosure*, November 1976, No. 15162; December 1978, No. 17626, all of which are incorporated herein by reference.

The charge balancing counter ion X may be any appropriate anion that can counterbalance the positive charge produced by the quaternary ammonium nucleus. As will be apparent to one of ordinary skill in the art, X may be selected from the group including, but not limited to, bromide ion, chloride ion, iodide ion, p-toluene sulfonate ion, ethyl sulfonate ion, perchlorate ion, trifluoromethane sulfonate ion, thiocyanate ion and picrate ion. If the heterocyclic quaternary ammonium nucleus further contains an anionic substituent such as a sulfoalkyl substituent, the counter ion is not necessary and n is zero. On the other hand, if the heterocyclic quaternary ammonium nucleus has two anionic substituents such as two sulfoalkyl groups, X represents a cationic counter ion such as an alkali metal ion, for example, sodium ion, potassium ion or the like, or an ammonium salt.

Nucleator compounds of Formula (I) are known in the art, as are their methods of preparation, as demonstrated by European Patent Applications Nos. 249,239, 255,009, 276,842, 278,986, 283,040, 283,041, 311,110, 315,890, and 331,185, U.S. Pat. No. 4,801,520 and German OFF. DE 3,721,570, all of which are incorporated herein by reference.

The solid particle dispersion of the nucleator which is included in the materials and methods of the present invention may be formed by precipitating the nucleator in the form of a dispersion and/or by well known milling techniques, for example, ball-milling, sand-milling or colloid-milling the nucleator in the presence of a dispersing agent. The nucleator particles in the dispersion preferably have an average size of less than about 10 μm and more preferably of less than about 1 μm. Examples of the preparation of solid particle dispersions are set forth in the Examples of the present specification and in U.S. Pat. Nos. 4,855,220, 4,857,446 and 4,900,653, all of which are incorporated herein by reference.

The amount of the water-insoluble nucleator in the form of the solid particle dispersion included in the photographic material may vary depending on the desired characteristics of the photographic material. Preferably, the photographic material includes from about $10^{-8}$ to about $10^{-2}$ mol of the water-insoluble nucleator per mol of silver halide.

The photographic materials of the present invention may be simple elements or multilayer elements. Additionally, the photographic materials may be black and white, color or multicolor elements. Multicolor elements contain dye image-forming units sensitive to each of the three primary regions of the spectrum. Each unit can be comprised of a single emulsion layer or of multiple emulsion layers sensitive to a given region of the spectrum. The layers of the element, including the layers of the image-forming units, can be arranged in various orders as known in the art.

A typical multicolor photographic element comprises a support bearing a cyan dye image-forming unit comprising at least one red-sensitive silver halide emulsion layer having associated therewith at least one cyan dye-forming coupler, a magenta image-forming unit comprising at least one green-sensitive silver halide emulsion layer having associated therewith at least one magenta dye-forming coupler and a yellow dye image-forming unit comprising at least one blue-sensitive silver halide emulsion layer having associated therewith at least one yellow dye-forming coupler. The element may contain additional layers, such as filter layers, interlayers, overcoat layers, subbing layers, and the like. The element typically will have a total thickness (excluding the support) of from 5 to 30 microns. The support may be transparent or reflective.

The photographic materials of the present invention may further contain additional components as is well known in the art and as disclosed in *Research Disclosure*, December 1978, Item 17643; January 1983, Item 22534: and December 1989, Item No. 308119, all of which are incorporated herein by reference. For example, the color elements of this invention can include couplers as described in *Research Disclosure*, Item 17643, cited above, Section VII, paragraphs D, E, F and G and the publications cited therein. These couplers can be incorporated as described in *Research Disclosure*, Section VII, paragraph C, and the publications cited therein. The couplers can be used with colored masking couplers as described in U.S. Pat. No. 4,883,746, image modifying couplers (including DIR's and timed or switched DIR's as disclosed in U.S. Pat. Nos. 3,148,062, 3,227,554, 3,773,201, 4,409,323 and 4,248,962, incorporated by reference) or with couplers that release bleach accelerators as described in European Patent Application No. 193,389.

The photographic elements of this invention can contain brighteners (*Research Disclosure*, Section V), antifoggants and stabilizers (*Research Disclosure*, Section VI), antistain agents and image dye stabilizers (*Research Disclosure*, Section VII, paragraphs I and J), light absorbing and scattering materials (*Research Disclosure*, VIII), hardeners (*Research Disclosure*, Section X), coating aids (*Research Disclosure*, Section XI), plasticizers and lubricants (*Research Disclosure*, Section XII), antistatic agents (*Research Disclosure*, Section XIII), matting agents (*Research Disclosure*, Sections XII and XVI) and development modifiers (*Research Disclosure*, Section XXI).

The direct-positive emulsion is employed to obtain a positive image, which is developed in accordance with procedures well known in the art for direct-positive emulsions. Development is followed by the conventional steps of bleaching, fixing, or bleach-fixing, to remove silver or silver halide, washing, and drying.

In a preferred embodiment of the present invention, the development rate of the exposed photographic material comprising the silver halide emulsion and the solid particle dispersion of the water-insoluble nucleator, is increased. That is, the developer which is employed contains an activator for the water-insoluble nucleator, whereby the development rate of the exposed photographic material is increased. In a preferred embodiment, the activator comprises a water miscible organic solvent, for example, a $C_1$-$C_{12}$ alcohol such as methanol, ethanol, propanol, isopropanol, or the like. Development of the image is then followed by the conventional steps of bleaching, fixing or bleach-fixing, to remove silver or silver halide, washing and drying.

The direct-positive photographic materials and methods of the present invention are demonstrated by the following examples, in which references are to parts by weight unless otherwise specified.

EXAMPLE 1

This example demonstrates the preparation of a solid particle dispersion of a nucleator compound and a direct-positive photographic material containing the solid particle dispersion. Specifically, 1.0 g of a nucleator compound of Formula (II) was mixed with 2.65 g of an aqueous solution of Triton X-200® surfactant (Rohm & Haas) (6.7% w/w) and 21.68 g of distilled water.

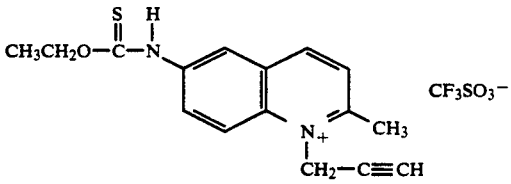

(II)

The pH of the resulting mixture was adjusted to 4.5. The resulting formulation was then transferred to a 60 cc screwcap bottle, and 137 g of zirconium oxide beads (1.8 mm) were added to the bottle. These operations were all performed in a nitrogen atmosphere. The bottle was then capped and placed on a SWECO mill. After milling for four days, the dispersion was warmed to 40° C. and mixed with 8 g of a 12.5% aqueous solution of gelatin. The dispersion was then mixed with an internally sensitized direct-positive (core-shell) silver bromide emulsion and coated in the following format on a supporting substrate to provide film strips:

| | | |
|---|---|---|
| Overcoat | 1.07 gm/m$^2$ gelatin | |
| | 0.096 g/m$^2$ hardener | |
| Emulsion Layer: | 1.55 g/m$^2$ Ag | 100 mg Nucleator per mole Ag |
| | 1.64 g/m$^2$ gelatin | |
| Undercoat: | 1.87 g/m$^2$ gelatin | |
| | 0.0094 g/m$^2$ 5-methyl benzotriazole | |
| | SUPPORT | |

Samples of the resulting film strips were exposed for 0.01 sec to a 2850K tungsten light source using a 21 step tablet. The exposed strips were then processed at 35° C. using the following sequence of steps:

| | |
|---|---|
| Developer: | 60 seconds |
| Fixer: | 15 seconds |
| Wash: | 30 seconds |

The developer employed in the developing step was a black-and-white developer available from Eastman Kodak Company as MX 1330-1 Developer and the fixer was KODAK RAPID FIXER.

The film strips were then dried for 15 seconds at 140° C. In order to determine the stability of the films to incubation (storage stability), additional samples of the film strips were stored at 49° C. and 50% relative humidity for four days prior to exposure and processing as described above. The minimum and maximum densities of the fresh and incubated films are set forth in Table I.

TABLE I

| | Dmin | Dmax |
|---|---|---|
| Fresh Film | 0.05 | 2.59 |
| Incubated Film | 0.11 | 2.54 |

COMPARATIVE EXAMPLE 1

In this example, a photographic film was prepared and processed in the manner described in Example 1 except that in this example, the solid particle dispersion of nucleator was replaced with a 1% solution of the nucleator compound in a solvent comprising methanol. The solution of nucleator was combined with the silver bromide emulsion in an amount sufficient to provide 100 mg nucleator per mol of Ag as in Example 1. Both fresh and incubated film strips were exposed and processed as described in Example 1, and the minimum and maximum densities of the resulting materials are set forth in Table II.

TABLE II

| | Dmin | Dmax |
|---|---|---|
| Fresh film | 0.06 | 2.60 |
| Incubated film | 0.42 | 2.58 |

A comparison of the results set forth in Tables I and II demonstrates that the photographic material of Example I exhibited a significantly improved stability during incubation as compared with the material of Comparative Example 1, particularly with reference to changes in the Dmin value. That is, while there was little change in the Dmin value between the fresh film and the incubated film of Example 1, thereby indicating that the film has good storage stability, the difference in the Dmin between the fresh film and the incubated film of Comparative Example 1 was significantly greater, thereby indicating that the film of Comparative Example 1 had poor storage stability.

EXAMPLE 2

This example demonstrates the improved method of developing a direct-positive photographic material according to the present invention. Specifically, photographic film materials were prepared in the same manner as described in Example 1. Additionally, the films were exposed and processed using the same sequence of steps as described in Example 1 for a first film. For a second film, the exposure and processing steps of Example 1 were followed except that the developer further contained 10% methanol. For both sets of film strips, the time for which the strips were in contact with the developer was reduced to 30 seconds. The minimum and maximum densities of the films are set forth in Table III.

| | Dmin | Dmax |
|---|---|---|
| Regular Developer (Ex.1) | 0.03 | 2.42 |
| Developer containing 10% methanol | 0.04 | 2.60 |

The results set forth in Table III demonstrate that the method employing the developer containing 10% methanol is characterized by a higher Dmax.

The preceding examples are set forth to illustrate specific embodiments of the invention and are not intended to limit the scope of the materials and methods of the invention. Additional embodiments and advantages within the scope of the claimed invention will be apparent to one of ordinary skill in the art.

What is claimed is:

1. A direct-positive image-forming photographic material comprising a supporting substrate bearing a light-sensitive, nonprefogged silver halide photographic emulsion capable of forming an internal latent image, said photographic material additionally comprising a solid particle dispersion of a water-insoluble nucleator of the formula (I)

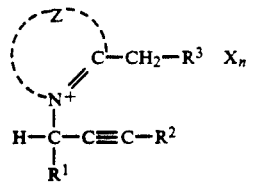

(I)

wherein Z includes an atomic group which forms an azolium or azinium ring with the quaternary ammonium nucleus, $R^1$ is hydrogen or methyl, $R^2$ is hydrogen or an alkyl group having 1 to 8 carbon atoms, $R^3$ is hydrogen or a substituent having a Hammett sigma value electron withdrawing characteristic of greater than −0.2 and, when taken together with Z, represents the atoms necessary to complete a ring structure, X is a charge balancing counter ion and n is zero or 1, provided that one of Z and $R^3$ includes a group for promoting adsorption by silver halide, the solid particle dispersion comprising nucleator particles having an average size of less than about 10 μm, and the photographic material including $10^{-8}$ to $10^{-2}$ mol of the water insoluble nucleator per mol of silver halide.

2. A direct-positive photographic material as defined by claim 1, wherein Z includes an atomic group which forms an azolium ring with the quaternary ammonium nucleus.

3. A direct-positive photographic material as defined by claim 2, wherein Z forms an indolium group with the quaternary ammonium nucleus.

4. A direct-positive photographic material as defined by claim 1, wherein Z includes an atomic group which forms an azinium ring with the quaternary ammonium nucleus.

5. A direct-positive photographic material as defined by claim 4, wherein Z forms a quinolinium group with the quaternary ammonium nucleus.

6. A direct-positive photographic material as defined by claim 1, wherein Z includes a thioamido group for promoting adsorption by silver halide.

7. A direct-positive photographic material as defined by claim 1, wherein the photographic material is a black-and-white photographic material.

8. A direct-positive photographic material as defined by claim 1, wherein the photographic material is a color photographic material.

9. A method of increasing the development rate of an exposed direct-positive image-forming photographic material comprising a supporting substrate bearing a light-sensitive, nonprefogged silver halide photographic emulsion capable of forming an internal latent image, the photographic material including a solid particle dispersion of a water-insoluble nucleator, said method comprising developing the exposed photographic material with a developer which includes and activator for the water-insoluble nucleator, the activator comprising methanol.

10. A method for improving the storage stability of a direct-positive image-forming photographic material comprising a supporting substrate bearing a light-sensitive, nonprefogged silver halide photographic emulsion capable of forming an internal latent image wherein the photographic material includes a water-insoluble nucleator of the formula (I),

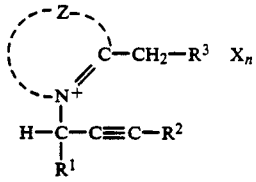

(I)

wherein Z includes an atomic group which forms an azolium or azinium ring with the quaternary ammonium nucleus, $R^1$ is hydrogen or methyl, $R^2$ is hydrogen or na alkyl group having 1 to 8 carbon atoms, $R^3$ is hydrogen or a substituent having a Hammett sigma value electron withdrawing characteristic of greater than −0.2 and, when taken together with Z, represents the atoms necessary to complete a ring structure, X is a charge balancing counter ion and in is zero or 1, provided that one of Z and $R^3$ includes a group for promoting adsorption by silver halide, said method comprising incorporating the water-insoluble nucleator in the photographic material in the form of a solid particle dispersion, the solid particle dispersion comprising nucleator particles having an average size of less than about 10 μm, and the photographic material including $10^{-8}$ to $10^{2}$ mol of the water insoluble nucleator per mol of silver halide.

11. A method of increasing the development rate of an exposed direct-positive image-forming photographic material comprising a supporting substrate bearing a light-sensitive, nonprefogged silver halide photographic emulsion capable of forming an internal latent image, the photographic material including a solid particle dispersion of a water-insoluble nucleator of the formula (I)

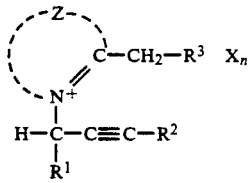

(I)

wherein Z includes an atomic group which forms an azolium or azinium ring with the quaternary ammonium nucleus, $R^1$ is hydrogen or methyl, $R^2$ is hydrogen or an alkyl group having 1 to 8 carbon atoms, $R^3$ is hydrogen or a substituent having a Hammett sigma value electron withdrawing characteristic of greater than −0.2 and, when taken together with Z, represents the atoms necessary to complete a ring structure, X is a charge balancing counter ion and n is zero or 1, provided that one of Z and $R^3$ includes a group for promoting adsorption by silver halide the solid particle dispersion comprising nucleator particles having an average size of less than about 10 μm, and the photographic material including $10^{-8}$ to 10−2 mol of the water insoluble nucleator per mol of silver halide, said method comprising developing the exposed photographic material with a developer which includes an activator for the water-insoluble nucleator, the activator comprising a water miscible organic solvent.

12. A method as defined by claim 11, wherein the water miscible organic solvent comprises a $C_1$–$C_{12}$ alcohol.

* * * * *